United States Patent [19]

Hupp

[11] 3,995,390

[45] Dec. 7, 1976

[54] RECHARGING DEVICE FOR FIREARMS, PARTICULARLY SHORT HAND FIREARMS

[75] Inventor: Gerhard Hupp, Oberndorf, Neckar, Germany

[73] Assignee: Industrie-Werke Karlsruhe Augsburg Aktiengesellschaft, Germany

[22] Filed: Aug. 6, 1974

[21] Appl. No.: 495,205

[30] Foreign Application Priority Data

Aug. 7, 1973 Germany ..... 2339875

[52] U.S. Cl. ..... 42/59; 42/89

[51] Int. Cl.[2] ..... F41C 1/00; F41C 25/00; F42B 39/04

[58] Field of Search ..... 42/89, 88, 59; 102/DIG. 1

[56] References Cited

UNITED STATES PATENTS

| | | | |
|---|---|---|---|
| 239,662 | 4/1881 | Martin | 42/89 |
| 457,658 | 8/1891 | McCarthy | 42/89 |
| 487,125 | 11/1892 | DeLatouche | 102/DIG. 1 |
| 603,218 | 4/1898 | Coon | 42/88 |
| 1,326,721 | 12/1919 | Glasser | 42/89 |
| 2,113,822 | 4/1938 | Barros | 42/89 |
| 2,215,726 | 9/1940 | Masterton-Smith | 42/89 |
| 2,866,386 | 12/1958 | Lucht | 42/59 |
| 2,889,654 | 6/1959 | LaFever | 42/59 |
| 3,159,938 | 12/1964 | Treat et al. | 42/59 |
| 3,348,484 | 10/1967 | Grandy | 102/DIG. 1 |

*Primary Examiner*—Charles T. Jordan
*Attorney, Agent, or Firm*—McGlew and Tuttle

[57] ABSTRACT

A firearm construction includes a housing mounting at least one, and preferably a plurality, of barrels, each having a firing bore terminating in an inner projectile charging end and including a magazine compartment in the housing around the projectile charging end of the barrel. A cartridge sealing sleeve is associated with each barrel and extends concentrically behind the projectile charging end and provides a centering for the projectile and the propelling charge therefor. The propelling charge and projectile are carried in a cartridge holder in the form of a plate having a plurality of circumferentially and preferably also radially spaced bores each of which includes a cartridge holder. The cartridge holders advantageously comprise short members having a rear end with a chamber defining a priming cap chamber which communicates through a central passage to an opposite front end in the form of a concave or recessed end which contains the propelling charge and the projectile. When the cartridge holder is positioned in the firearm magazine compartment, the projectiles which extend outwardly from the propelling charge are centered within the bore of the cartridge sealing sleeve. The priming chamber at the rear end of the cartridge holder is in a position to be engaged by a movable cartridge striking pin or firing mechanism.

5 Claims, 3 Drawing Figures

RECHARGING DEVICE FOR FIREARMS, PARTICULARLY SHORT HAND FIREARMS

BAKCGROUND OF THE INVENTION

1. FIELD OF THE INVENTION

This invention relates in general to the construction of firearms and cartridge holders and, in particular, to a new and useful firearm construction and to a cartridge holder which comprises a flat plate having a plurality of bores containing individual cartridge holding elements which have a recess on their inner face which receives the propelling charge and projectile and an opposite face which defines a priming chamber which is connected through a passage to the fron face and which also carries a propelling charge on the front face with a central projectile which is seated in a cartridge sealing sleeve which surrounds the bore of each barrel.

2. DESCRIPTION OF THE PRIOR ART

The present invention is particularly applicable for use with firearms, particularly a short hand firearm, which is recharged simultaneously with a plurality of cartridges which are all introduced into a drum-like or disc-like housing. The cartridge holder is adapted to be fitted into a chamber of the firearm which opens along a parting slit line approximately diagonally, and the cartridge holder includes a centering bore for positioning it on a boss of the magazine chamber in order that the individual cartridges will be centered in respect to the various rifle bores.

The known constructions includes particularly a short hand firearm which operates preferably with caseless cartridges, as well as a device for carrying out the charging of the firearm. The device comprises a substantially ring-shape or disc-shape body which serves to receive a plurality of caseless cartridges. On both of its ends, the body is hermetically closed by covers which conform to its outline. When the drum-like magazine of the firearm is to be recharged, first the two covers are removed from the body receiving the caseless ammunition. One of these covers is provided with a plurality of hollow cylindrical stubs corresponding to the number of cartridges. By means of the hollow cylindrical stubs, all of the caseless cartridges which are seated and slightly clamped in the individual bores of the ring- or disc-shape body, are simultaneously introduced into the magazine of the firearm. With this known device, the recharging is effected relatively quckly. After charging, the ring- or disc-shape body, as well as the covers which initially close the same, are thrown away at the place of action.

In order to prevent such losses of material, which in action may amount to a considerable extent, there has been proposed that the circumferentially arranged bores in the disc-shape holder be designed in the form of cartridge cases in which both the charges and the projectiles are directly placed. Bushes, sleeves, or similar arrangements are provided for sealing the barrel and the cartridge seat and also for compensating for the diameter differences between the projectiles and the respective charges.

A drum in which the cartridges of this kind are received can be inserted into a correspondingly designed magazine of the firearm without using any auxiliary means, such as, for example, covers which are provided with hollow cylinder stubs. Because of its rechargeability, the ring- or disc-shape body is not thrown away at the place of action. However, the recharging is somewhat expensive, quite aside from the fact that for constructional reasons, the ring- or disc-shape body can receive only a relatively limited number of cartridges which is undesirable in action.

SUMMARY OF THE INVENTION

In accordance with the present invention, the cartridge holder does comprise a ring- or disc-shape body and employs caseless cartridges which are arranged in a storage drum holder. After the consumption of the ammunition stored therein not only can they be refilled with the caseless cartridges without much expense, but they are also constructed so that they hold a larger quantity of ammunition. With the inventive arrangement, each of the bores in a disc plate is adapted to receive a cartridge bottom which are of identical design and which include an interior face forming an inwardly curved recess defining retention sides for holding a propelling charge of a cartridge behind a projectile extending outwardly from the opposite end thereof. The caseless cartridge comprises a projectile and its propelling charge.

In a further development of the inventive idea, there is provided a cartridge bottom which is interchangeable and is provided with an appropriately shaped recess at its rear or outer end for receiving a priming cap and the priming cap chamber communicates through a priming passage extending from the rear end to the forward interior cavity at the opposite end.

The invention offers numerous advantages:

As compared to the known kinds of cartridge holders, the ring- or disc-shape body comprises merely a flat plate of annular form having a plurality of radially and circumferentially spaced bores. The central bore provides means for aligning it over a central boss of the magazine chamber of the firearm. Each bore receives a cartridge bottom and the construction of the plate is such that a large number of bores may be provided. This is further enhanced because of the relative small diameter of the caseless ammunition so that a very large quantity of ammunition may be carried in the cartridge holder. This is a decided advantage in action because there is always a large reserve of ammunition at ones disposal and the large capacity of each charge holder means that the recharging intervals will be substantially longer. This last fact is particulary decisive inasmuch as during the recharging of new ammunition, the user is generally incapable of action.

The above advantages are not the sole advantages since it is equally advantageous that the ring- or disc-shape body can be provided with caseless cartridges for repeated use over and over again. To this end, there is provided a construction in which the cartridge bottoms may also be easily interchanged with others which are provided with priming caps.

Accordingly, it is an object of the invention to provide a firearm construction, which includes a magazine chamber for one or more firing barrels, having cartridge sealing sleeves extending concentrically to the barrel bore and rearwardly from the barrel, which provide means for aligning and engaging projectiles of caseless ammunition which is carried in a cartridge holder in the form of a plate having bores which carry cartridge bottoms with interior ends forming recesses for receiving the cartridges, and exterior ends forming cavities for the priming cap.

A further object of the invention is to provide a cartridge holder which comprises a flat plate having a plurality of bores therein which are provided with cartridge bottoms having interior ends forming cavities which accommodate one end of caseless ammunition in the form of a propellant charge and a projectile and an opposite end which has a chamber for accommodating a priming cap which communicates through a small diameter bore to the cartridge chamber.

A further object of the invention is to provide a firearm construction and a cartridge holder construction which are simple in design, rugged in construction, and economical to manufacture.

The various features of novelty which characterize the invention are pointed out with particularly in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
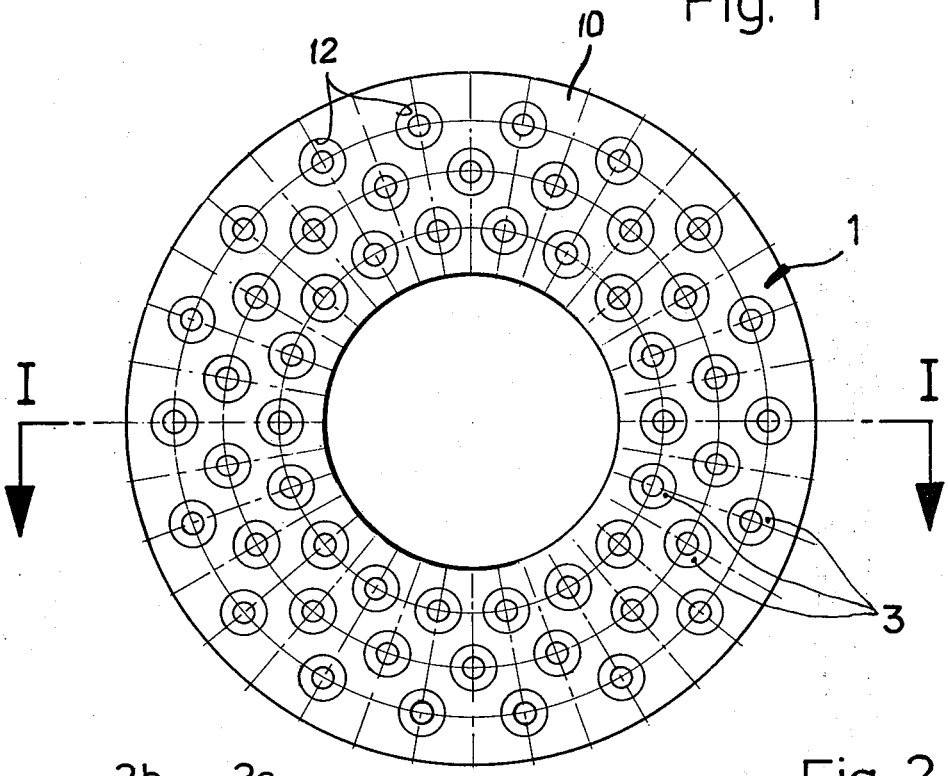
FIG. 1 is a rear elevational view of the cartridge holder constructed in accordance with the invention.
Figure 2:
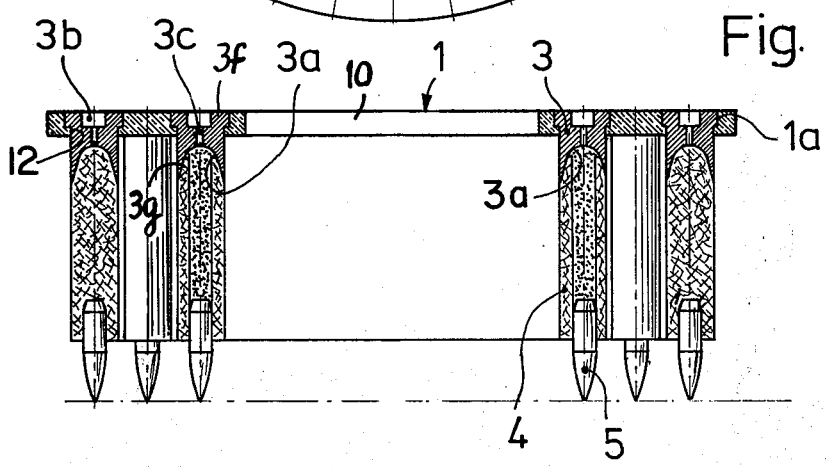
FIG. 2 is a section taken along the line I—I of FIG. 1.

Referring to the drawings in particular, the invention embodied therein, comprises a cartridge holder, generally designated 1, which in the embodiment illustrated, comprises a flat plate or disc- or ring-shape body 10, having a plurality of circumferentially spaced and radially spaced bores 12 which are sufficient to accommodate cartridge bottoms, generally designated 3. In accordance with the invention, cartridge bottoms 3 include widened flange end portions 3*f* which fit into widened flange rear end portions of plate 10, and uniform diameter smaller portions 3*g*, which extend forwardly in the openings or bores 12 of plate 10. The inner end of bottoms 3 are provided with recesses or cavities 3*a* which form retaining sides of bases for a propelling charge 4 which carries a projectile 5 at its front end. The cartridge bottoms 3 are fitted with a tight fit and can be removed, if needed, by means of a suitable tool or removal device (not shown). The opposite side of cartridge bottom 3 is provided with a cavity 3*b* for receiving a priming cap or similar ignition device, and this cavity communicates through a small passage 3*c* to the opposite face 3*a*.

A firearm constructed in accordance with the invention, and generally designated 20, comprises a plurality of barrels, 7, 7*a* and 7*b*, arranged in a housing 22, which includes a magazine chamber 24. Magazine chamber 24 includes a central boss or mounting part 26 for centering the cartridge holder 1 and a magazine member or drum 30. Individual cartridge bottom reclining bores of the plate 10 are aligned with through bores of the drum 30 and bores of a cartridge seat or sealing sleeves 6 which are carried on each of the drum bores. Sleeves 6 are centered in succession in respect to the bores of the rifle barrels and the sleeves extend rearwardly from the loading end of the barrel bores and have rear shoulders 6*a* which serve as seals or seats for the propelling charges 4 and as centering means for the projectiles 5. The projectiles 5 are seated in blind bores formed in the ends of each charge and have front ends which extend into the sleeves 6.

Figure 3:
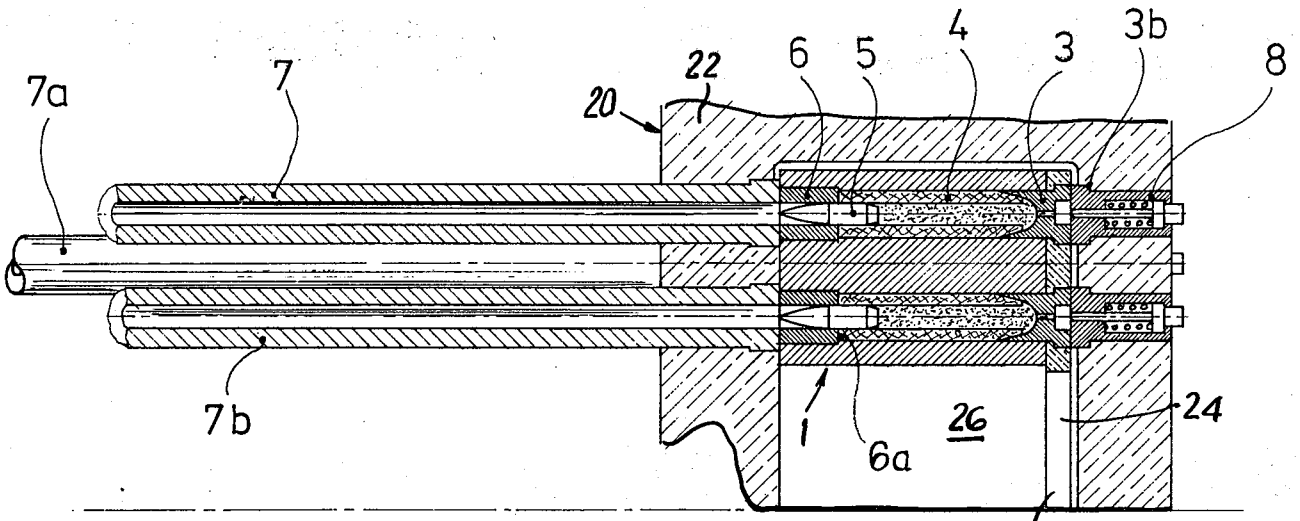
FIG. 3 is a partial axial sectional view of a firearm constructed in accordance with the invention.

In the position indicated in FIG. 3, all of the individual bores 12 of cartridge holder plate 10, which contain the cartridge bottom 3, are aligned either initially or successively with the gun barrel bores and the associated bores of sleeve 6 and firing mechanism, generally designated 8, which is associated with each gun barrel.

While a specific embodiment of the invention has been shown and described in detail to illustrate the application of the principles of the invention, it will be understood that the invention may be embodied otherwise without departing from such principles.

What is claimed is:

1. A firearm construction comprising a housing, at least one barrel on said housing having a firing bore terminating in an inner projectile charging end, said housing having a magazine compartment surrounding the projectile charging end of said barrel and having a cartridge sealing sleeve centered in respect to the bore of each of said at least one barrel and projecting rearwardly from said barrel into said magazine compartment, and a cartridge holder in said magazine compartment having a base plate with a plurality of circumferentially spaced cartridge holder bores therein, a cartridge bottom in each of said cartridge holder bores having a rear face with a priming cap chamber and a front face with a recess defining a cartridge seat, a propellant charge having an inner end engaged on said cartridge seat and an outer end with a blind bore and extending outwardly from said cartridge bottom so that its outer end is engaged against an end of said sealing sleeve, and a projectile having an inner end engaged in the blind bore of said propellant charge and an outer end extending into said cartridge sealing sleeve.

2. A firearm construction, according to claim 1, including a firing mechanism aligned with said barrel.

3. A firearm construction, according to claim 1, including a plurality of barrels on said housing, each barrel having an associated firing mechanism and each carrying a cartridge sealing sleeve.

4. A firearm construction comprising a housing, a plurality of barrels in said housing each having a firing bore terminating in an inner projectile charging end, said housing including a magazine compartment formed rearwardly of said projectile charging ends of said barrels, a magazine drum located in said magazine compartment and having cartridge bores therethrough with a cartridge sealing sleeve located in each of the said cartridge bores adjacent the projectile charging ends of the firing bores of said barrels and being selectively alignable therewith, and a cartridge holder associated with said drum comprising a flat plate having a plurality of circumferentially spaced cartridge holder bores therein which are alignable with the bores of said drum, a cartridge bottom in each of said cartridge holder bores having a rear face with a priming cap chamber and a front face with a recess defining a cartridge seat, a propelling charge having an inner end engaged over said cartridge seat and an outer end with a blind bore and with its peripheral edge engaged against said sealing sleeve, the periphery of said propellant charge between said cartridge bottom and said sleeve being engaged in the associated bore of said drum, and a projectile having an inner end engaged in the blind bore of said propellant charge and an outer end extending into said cartridge sealing sleeve.

5. A barrel cartridge holder for use with a firearm having a magazine drum with a plurality of circumferentially spaced drum bores therein each having a sealing sleeve at the inner end of the bore which is alignable with the barrel of the firearm and which define inner shoulders at the interior of the drum bores, comprising a flat cartridge holder plate adapted to be associated with the drum and having a plurality of circumferentially spaced cartridge holder bores therein alignable with the drum bores, a cartridge bottom in each of said cartridge holder bores having a rear face with primer cap means and a front face with a recess defining a cartridge seat, a propelling charge having an inner end engaged over said cartridge seat and being of a length to extend from said cartridge seat to the sealing sleeve in the drum bores, said propelling charge having an end opposite said inner end with a blind bore, the edge around said blind bore defining a sealing edge engageable with the sealing sleeve, and a projectile engaged in the blind bore and having a tip projecting beyond the edge of said propelling charge to be engaged in the bore of the sealing sleeve.

* * * * *